US005678248A

United States Patent [19]

Lengyel

[11] Patent Number: 5,678,248

[45] Date of Patent: Oct. 21, 1997

[54] MITTEN WITH FINGER BREAKOUT

[76] Inventor: Alex A. Lengyel, 111 Claridge Dr., Coraopolis, Pa. 15108

[21] Appl. No.: 546,683

[22] Filed: Oct. 23, 1995

[51] Int. Cl.[6] ..... A41D 25/00

[52] U.S. Cl. ..... 2/158; 2/159

[58] Field of Search ..... 2/158, 159, 163, 2/161.6

[56] References Cited

U.S. PATENT DOCUMENTS

| | | | |
|---|---|---|---|
| 338,790 | 3/1886 | Slack | 2/158 X |
| 428,115 | 5/1890 | Levy | 2/158 |
| 1,849,418 | 3/1932 | Chesebro | 2/158 |
| 2,274,335 | 2/1942 | Kennedy | 2/158 |
| 2,315,889 | 4/1943 | Wells | 2/158 |
| 2,318,785 | 5/1943 | Kopplin | 2/158 |
| 2,323,136 | 6/1943 | Johanson | 2/158 |
| 2,571,228 | 10/1951 | Freeman et al. | 2/158 |
| 2,675,554 | 4/1954 | Gertz | 2/158 X |
| 2,830,299 | 4/1958 | Thilenius | 2/158 |
| 3,052,889 | 9/1962 | Furey | 2/158 |
| 3,299,441 | 1/1967 | Slimovitz | 2/158 |
| 3,403,408 | 10/1968 | Helfer | 2/158 |
| 4,383,336 | 5/1983 | Beckman et al. | 2/158 |
| 4,980,929 | 1/1991 | Long | 2/158 X |

FOREIGN PATENT DOCUMENTS

| | | | |
|---|---|---|---|
| 350851 | 6/1931 | United Kingdom | 2/158 |
| 821304 | 10/1959 | United Kingdom | 2/158 |

*Primary Examiner*—C. D. Crowder
*Assistant Examiner*—Shirra L. Jenkins
*Attorney, Agent, or Firm*—Carothers & Carothers

[57] ABSTRACT

A sportsman's mitten which has a flexible hand enclosing glove member that is adapted to enclose and confine a human hand therein in a non-extended closed configuration. An outer-most distal end of the mitten enclosure is slit open to provide an opening for permitting extension of the enclosed fingers of the hand such that they can extend therethrough and beyond by merely extending ones fingers outwardly from the closed configuration. A conventional hook and loop fastener mechanism temporarily closes this distal end opening and is adapted for easy quick opening again by mere extension pressure applied thereto by the outward extension of ones fingers from the closed or fist-like configuration.

3 Claims, 2 Drawing Sheets

MITTEN WITH FINGER BREAKOUT

BACKGROUND OF THE INVENTION

The present invention relates to improvements in mittens, and more particularly to mittens which include an opening which is slit-like in construction to enable fingers of the hand to be extended through the opening.

A number of mitten-like hand coverings or gloves have been developed in the prior art which provide a transverse slit-like opening through which one or more fingers, or the entire hand, may pass. For example, such mitten structures are illustrated in U.S. Pat. Nos. 2,274,335, 3,299,441 and 4,383,336.

Such mittens or gloves are provided for the sportsman, such as hunters and fisherman, so that they can readily expose their fingers to manipulate objects, such as the trigger of a gun or fishing lures. These prior art mittens are all provided with slit-like openings in the palm of the glove or mitten so that the fingers may be extended therethrough without removing the glove to enable the fingers to be readily employed for any such desired task.

Generally these palm slit-like openings are provided with a closure or fastening means to maintain them in a closed condition until used. For example, they are generally held closed in a sealed manner as by conventional hook and loop fastener means, such as manufactured under the trademark Velcro.

The Problem encountered with such prior art mittens is that it takes considerable manipulation on the part of the wearer to manipulate ones fingers down to the position of the slit-like palm opening within the glove, and then to manipulate and work the fingers through the slit and out of the glove. In addition, even after ones fingers and/or the whole hand has been inserted through the slit, then the forward mitten area or portion of the mitten or glove still remains, flapping loosely behind ones exposed fingers thereby providing an unwanted hinderance or obstruction, which is objectional when one is trying to manipulate his hands to accomplish a task. In addition, ones hands cannot be protruded from the gloves in as fast a manner as is desirable due to the awkwardness of trying to find and protrude ones fingers through a palm slit in the mitten, which is provided in a position well below the finger tip portion of the glove or mitten.

It is a principal object of the present invention to provide a mitten for the sportsman which maintains the sportsman's hand in a much warmer condition, and additionally allows the sportsman to much more quickly expose his fingers through or beyond the glove opening in order to permit the sportsman to have immediate use of his exposed fingers for manipulation of a desired item.

SUMMARY OF THE INVENTION

The mitten of the present invention includes a flexible hand enclosing member that is adapted to enclose and confine a human hand in a non-extended closed or fist-like configuration, which maintains the hand in an extremely warm condition, and retains ones fingers of the hand in a configuration which permits immediate extension thereof out of and beyond the glove tip.

The outer-most distal end of this mitten enclosure is slit open to provide an opening for permitting extension of the enclosed fingers to extend through the extremity slit merely by extending ones fingers outwardly from the closed fist configuration. This extremity distal slit is secured together temporarily by a fastening means such as conventional hook and loop fastener as is manufactured under the trademark Velcro. Thus the distal perimetrical slot may be easily, quickly, and readily opened with mere extension pressure of ones fingers applied thereto by the outward extension of ones fingers from the closed or fist-like configuration.

The mitten may include a segregated thumb enclosure portion for separately enclosing the thumb portion of the human hand, as desired.

BRIEF DESCRIPTION OF THE DRAWINGS

The accompanying drawings show, for the purpose of exemplification, without limiting the invention or the claims thereto, certain practical embodiments illustrating the principals of the present invention wherein:

DETAILED DESCRIPTION OF A PREFERRED EMBODIMENT

Figure 2:
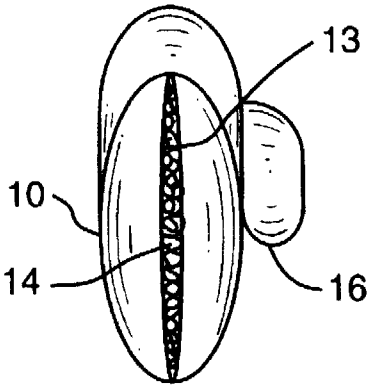
FIG. 2 is an outer end view of the left end portion of the mitten shown in FIG. 1.
Figure 1:
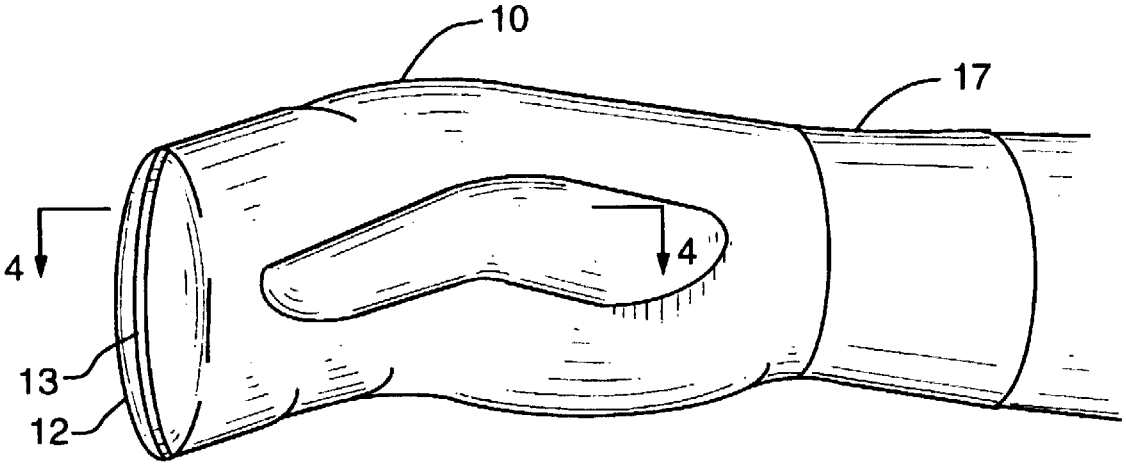
FIG. 1 is a view in perspective showing the mitten of the present invention with a distal end slit or opening closed by a hook and loop fastener mechanism.
Figure 4:
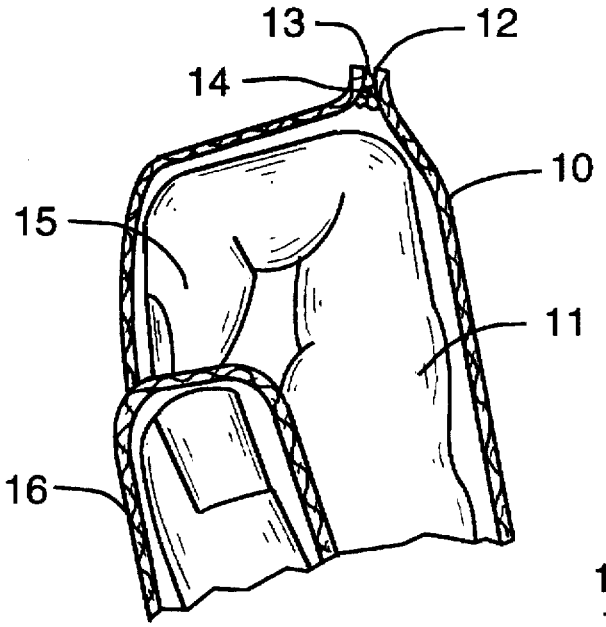
FIG. 4 is a side view in elevation illustrating the mitten in partial cross-section as viewed along lines 4—4 of FIG. 1.

Referring to the drawings, the flexible hand enclosing mitten 10 is adapted to enclose and confine the human hand 11 in a non-extended closed or fist-like configuration as illustrated in FIGS. 1, 2 and 4.

As is also shown in these figures, the outer-most distal end 12 of the mitten 10 is provided with a slit opening 13 which is fastened or secured shut temporarily with conventional hook and loop fastener 14, such as manufactured under the trademark Velcro. This distal end slit 13 is therefore adapted for opening by mere extension pressure alone applied thereto by the outward extension of ones fingers 15 from the closed configuration shown in FIGS. 1, 2 and 3 to the fully extended position illustrated in FIGS. 3 and 4.

The mitten 10 is shown to include a segregated thumb enclosure portion 16. However, this is not essential and the entire hand or fist of the wearer may be simply enclosed within a single sack portion of the mitten 10.

Figure 3:
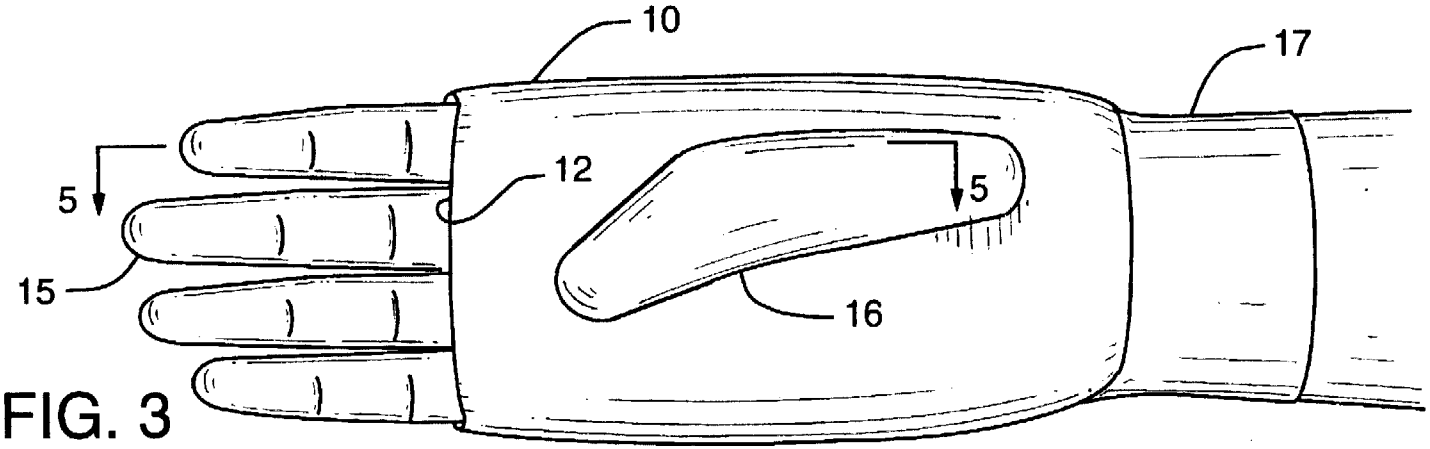
FIG. 3 is a similar view in perspective of the mitten shown in FIG. 1 illustrating the distal slit opened with projection of the fingers therebeyond.
Figure 5:
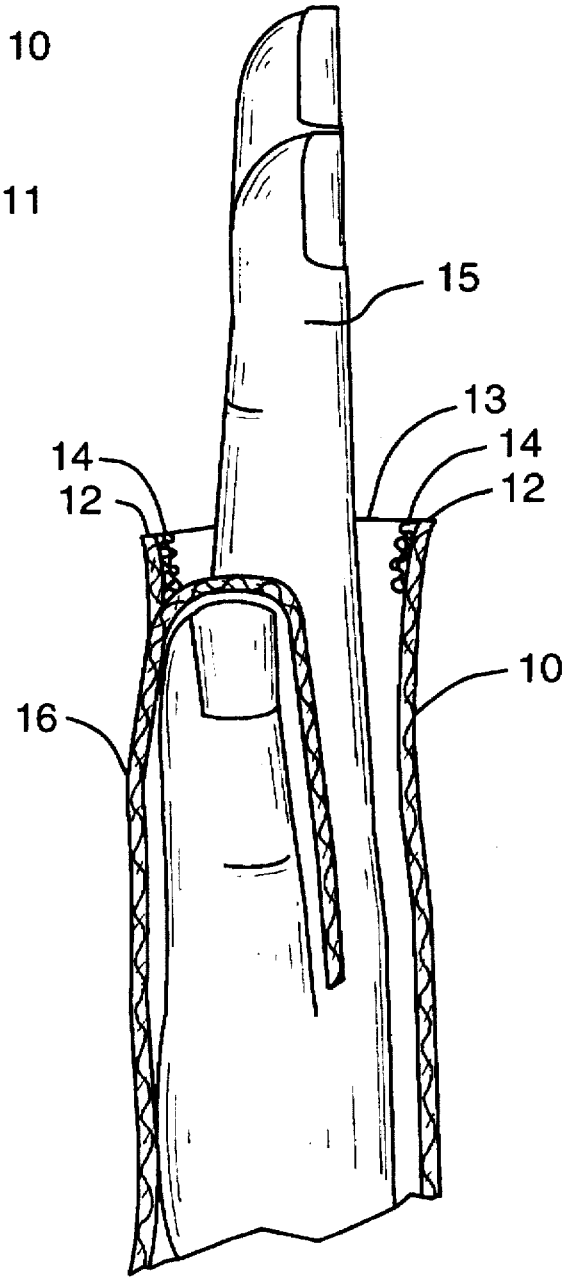
FIG. 5 is a side view in elevation showing the mitten in partial cross-section as viewed along section line 5—5 of FIG. 3.

The mitten is retained on the wearer's hand by use of a conventional elastic cuff 17. Elastic cuff 17 also helps to hold the glove in position such that when the wearer extends his fingers 15 through slit or opening 13 and Velcro fastener 14, the glove will remain in its original worn position as illustrated in the figures thereby permitting the fingers 15 to extend well beyond the end slit 13 as illustrated in FIGS. 3 and 5. The mitten 10 is of predetermined length from the elastic cuff 17 to the outer-most distal end 12. This predetermine limited length is defined by the distance between the wrist and the proximal interphalangeal joint of the third finger of the human hand 11 to be enclosed in the mitten. This limitation permits the mitten to function in the manner described.

Accordingly, by one merely extending his fingers from the closed hand position as shown in FIGS. 1, 2 and 4, the fingers 15 will immediately break through the normally closed end slit 13 for protrusion and immediate use as shown in FIGS. 3 and 5.

This is accomplished without having to manipulate and grope for a palm slot, and without the unwanted interruption or interference of a mitten end flap which remains positioned behind ones extended fingers after they are protruding from the mitten or glove.

I claim:

1. A mitten comprising: A flexible hand enclosing member of predetermined limited length which is defined by the distance between the wrist and the proximal interphalangeal joint of the third finger of a hand to be enclosed therein which thereby requires a human hand when enclosed therein to be in a non-extended closed configuration, an outer-most distal end of said enclosure slit open to provide an opening for permitting extension of fingers of a closed hand enclosed therein to extend therethrough and therebeyond by extending ones fingers outwardly from said closed configuration beyond said limited length, and hook and loop fastener temporarily closing said opening for thereby fully enclosing and confining a human hand in said hand enclosing member in a non-extended closed configuration and for opening said opening with mere extension pressure applied thereto by the outward extension of ones fingers from said closed configuration.

2. The mitten of claim 1 including a segregated thumb enclosure portion for separately enclosing a thumb portion of a human hand.

3. The mitten of claim 1, said mitten including an elastic wrist cuff for retaining said mitten in position when worn.

* * * * *